United States Patent [19]

Hinchcliffe et al.

[11] 4,365,703

[45] Dec. 28, 1982

[54] STORING ROD-LIKE ARTICLES

[75] Inventors: Dennis Hinchcliffe, London; Eric A. Luddington, Ringwood, both of England

[73] Assignee: Molins Limited, London, England

[21] Appl. No.: 291,463

[22] Filed: Aug. 10, 1981

Related U.S. Application Data

[63] Continuation of Ser. No. 973,704, Dec. 27, 1978, abandoned.

[30] Foreign Application Priority Data

Jan. 11, 1978 [GB] United Kingdom ..... 1017/78

[51] Int. Cl.[3] ..... B65G 1/04

[52] U.S. Cl. ..... 198/347; 53/236; 53/539; 414/413

[58] Field of Search ..... 198/347; 414/407, 413, 414/414; 53/148, 236, 247, 248, 539; 141/243, 244

[56] References Cited

U.S. PATENT DOCUMENTS

| | | | |
|---|---|---|---|
| 2,933,872 | 4/1960 | Pollmann | 53/236 X |
| 3,817,369 | 6/1974 | Bluthardt et al. | 198/347 |
| 3,920,134 | 11/1975 | Scarpa et al. | 53/251 X |
| 3,967,740 | 7/1976 | Molins | 53/148 X |
| 4,078,648 | 3/1978 | Hinchcliffe et al. | 198/347 |

FOREIGN PATENT DOCUMENTS

| | | | |
|---|---|---|---|
| 1066118 | 9/1959 | Fed. Rep. of Germany | 53/236 |
| 2347674 | 4/1974 | Fed. Rep. of Germany | 198/347 |
| 2716823 | 11/1977 | Fed. Rep. of Germany | 198/347 |
| 2035248 | 6/1980 | United Kingdom | 198/347 |

*Primary Examiner*—Jeffrey V. Nase

*Attorney, Agent, or Firm*—Antonelli, Terry and Wands

[57] ABSTRACT

Apparatus for handling rod-like articles incorporates a buffer reservoir system using trolleys having vertical compartments for storing the articles in stack formation. The compartments receive the articles from outlets in a first conveyor and may return articles to a second conveyor through inlets. The first conveyor may form part of a conveyor system linking one or more cigarette making machines to one or more cigarette packing machines. The outlets are closable by a gate and a platform is moved through each compartment to lower articles from the outlet. The bottoms of the compartments are provided with removable slats. A particular form of closure suitable for separating a stack of rod-like articles and apparatus for loading and unloading containers with rod-like articles are also disclosed.

20 Claims, 18 Drawing Figures

STORING ROD-LIKE ARTICLES

This is a continuation of application Ser. No. 973,704, filed Dec. 27, 1978, now abandoned.

This invention is concerned with apparatus for handling rod-like articles such as cigarettes or cigarette filter rods. More particularly the invention relates to conveyor systems for such articles, including a reservoir for the articles.

It is often desirable to provide temporary storage facilities for rod-like articles. For example, in the transport of cigarettes from a cigarette making machine to a cigarette packing machine a buffer store may be provided so that if either of the machines is stopped the other may continue in operation for some time. Where several machine complexes are in operation it may be that in one complex the making machines consistently produce more than their associated packers can accept whereas in another complex the makers cannot keep the packers fully occupied. In such circumstances it can be useful to accept cigarettes from the one complex and transfer them to the other complex. British Patent Specification Nos. 1,404,141, and 1,404,142, and South African Patent Specification No. 76/4269 describe suitable systems in which the rod-like articles are stored and moved in trays.

German OS 2,716,823 discloses systems incorporating reversible mobile reservoirs which can be used to replace the afore-mentioned tray systems. This invention relates to mobile reservoirs including a conveyor system adapted to receive rod-like articles as a stack moving in a direction transverse to the lengths of the articles and for storing the articles. The rod-like articles can be supplied and stored as a continuous stream or in batches. A reservoir may be adapted for connection to a static conveyor system so that direct transfer to or from the conveyor system is possible and, in addition, so that drive for the conveyor may be derived from a static motor unit associated with the system. The reservoir may be mounted on wheels and could be moved on a track system. Guides may be provided for directing the reservoir into position for connection to a static conveyor system.

One aspect of the invention provides a conveyor system for rod-like articles including first and second conveyors for moving the articles in stack formation in a direction transverse to their lengths, at least one outlet for delivering articles from the first conveyor, at least one inlet for delivering articles to said second conveyor, said outlet and inlet being spaced apart, a movable reservoir having a plurality of compartments, each compartment having an entrance and an exit for articles, means defining a path for said reservoir whereby the reservoir may be positioned on said path so that a compartment may be loaded with articles passing from said outlet to the entrance of said compartments and whereby the reservoir may be positioned on said path so that a compartment may be unloaded by articles passing from the exit of said compartment to said inlet.

Each compartment is preferably arranged to receive a batch of articles in stack formation and may conveniently receive a stack directly from said outlet and eventually return the stack directly to said conveyor through the inlet. Said compartments and said outlet and inlet may be arranged so that compartments may be loaded and unloaded by articles moving under the action of gravity. In a preferred arrangement the compartments comprise substantially vertical channels. Conveniently, the width of each channel may correspond to the width of said outlet and inlet. The reservoir preferably comprises a trolley or other conveyance but could comprise an endless conveyor provided with partitions defining the compartments.

When the compartments comprise substantially vertical channels they preferably each have an entrance at their upper ends and an exit at their lower ends. The exit is normally closed by a removable closure. The compartments may therefore be loaded directly by passing beneath an outlet. A closure member is associated with this outlet to block it when not in use. This closure member may comprise a movable band assembly. Similarly, the compartment may be unloaded by removing the closure member associated with the exit and allowing the articles to pass downwards into an inlet.

The outlet and inlet of the first and second conveyor are respectively associated with a loading and unloading station. The inlet and outlet may be adjacent and may each be associated with a combined loading/unloading station. For example the inlet could be positioned directly below the outlet so that a vertical compartment can be in simultaneous registration with the outlet and inlet.

The loading station (which may be combined with the unloading station as referred to in the previous paragraph) preferably includes some means for allowing progressive loading of each compartment. In the preferred arrangement, where the compartments are vertical channels, this may take the form of a platform which may be inserted into the compartment and progressively lowered through it during loading. The unloading station preferably includes some means for withdrawing the closure member associated with the exit of each compartment (and for reinserting it after the compartment has unloaded into the inlet).

The conveyor system preferably includes a drive for the reservoir, which may be in the form of an indexing mechanism for moving the reservoir to position successive compartments at the loading and/or unloading station.

Each reservoir could be provided with two or more parallel sets of compartments for simultaneous loading and/or unloading. The conveyor may then be provided with appropriately spaced outlets and inlets for delivering to and receiving from the compartments. A combined inlet could receive the output from the exits of compartments in different sets.

The outlet and inlet may each be connected to parts of the first and second conveyor which branch from a main conveyor path in a system linking one or more article producing machines to one or more article packing machines, so that articles may be loaded into the reservoir of the system or unloaded from the reservoir as required by conditions in said main path. In such case it is convenient to arrange the path of the reservoir to pass between the outlet and inlet so that a compartment of the reservoir may be in simultaneous registration with the outlet and inlet. In an alternative conveyor system the outlet and inlet may be at ends of a discontinuity between said first and second conveyors and may be spaced in relation to the path of the reservoir. Accordingly, all articles in the system pass into a compartment from the outlet, are conveyed while in the compartment along the path of the reservoir, and are subsequently returned to the conveyor through the inlet. This arrangement can be useful to provide an extended length of time spent by each article passing along the conveyor.

In one preferred form the conveyor system includes a closure member for said outlet. A closure member as disclosed herein is usable generally to separate rod-like articles.

Accordingly, another aspect of the invention provides a method for separating rod-like articles on a path for said articles in stack formation comprising projecting a separating device across said path in a direction transverse to the lengths of the articles, wherein, as said device is projected across said path, the projected part of said device includes at least one surface which remains stationary relative to said path as the device is further projected across said path. By adopting this method, friction in inserting the device may be reduced to a minimum and rubbing against the articles can be avoided. Thus possible damage to and disturbance of the articles is also avoided.

Apparatus for separating a stack of rod-like articles according to this method may comprise means defining a path for rod-like articles in stack formation, a separating device including a guide for at least one flexible band, some means for projecting the device across said path, and some means for holding said band stationary on one side of the guide relative to the path as the device is moved across said path. The device may comprise a support which is progressively projected across said path behind that part of the band which is held stationary relative to said path.

The guide may comprise at leat one pulley around which the band passes. Laterally-spaced bands with a guide comprising two or more laterally-spaced pulleys could be provided. The position and movement of the pulley or pulleys can be controlled directly, e.g. by a pneumatic piston assembly, or by movement of the band or bands. The latter may be held stationary (relative to the articles) by being fixed at one end or, if an endless band is used, by holding stationary a pulley around which the band passes. In this case the band also passes around tensioning means which allows movement of the separating device while part of the band remains stationary.

The path for the rod-like articles may comprise a conveyor and may confine the articles above and below (or at both sides of) the stack. Where it is required to separate a stack which may be substantially continuous and which is substantially confined, some means may be provided to facilitate entry of the separating device. Such means could consist of means for increasing the available volume adjacent the device, either by moving articles away or by temporarily removing the confinement on the article in the region of the device.

The separating device may be withdrawn so that a continuous stack can be assembled or reassembled on the path. Normally, but not necessarily, said one side of the band is kept stationary during withdrawal of the device.

One use for the present seoarating apparatus is to divide a stream of rod-like articles on a substantially horizontal conveyor into batches. For example, the separating device can be arranged so that it may be projected upwards between laterally-spaced bands of a stream conveyor. In this arrangement it is preferable for both sides of the separating device to remain stationary relative to the articles in the stream so that the device causes minimum disturbance to the stream as it is projected upwards. Thus, the separating device may comprise at least two separate bands and a guide, so that the outer sides of the device in contact with the articles comprise stationary parts of the respective bands. The moving parts of the bands pass between the stationary outer parts.

Another use for the separating device is in association with a chute or elevator for rod-like articles, where the device may be used as a gate which is movable substantially horizontally to prevent passage of articles. Opposed separating devices on opposite sides of the path may cooperate to close the gate. A pivoted bridge piece or other closure element could be provided to fill any gap between the confronting ends of the separating devices. Alternatively each device may comprise laterally spaced guide member for laterally spaced bands, the respective guide member being offset so that the devices may effectively overlap. Alternatively, or additionally, the devices may be at different levels and may overlap in their closed position. The space between the lower band of the upper device and the upper band of the lower device may conveniently be about one article diameter in this position. One important application of the use of one or more separating devices to close an opening at the upper end of a chute or elevator is where a container may be loaded or unloaded through said opening. For example, the separating device may be used to close the opening after a container has been filled by rod-like articles moved upwards into the container by means of an elevator.

According to another aspect of the present invention, apparatus for loading and unloading a container comprises means for holding a container over an opening through which a stack of rod-like articles may be passed to or from the container, a separating device as previously described for closing said opening, and a conveyor for moving a stack of articles to or from the opening.

When it is required to insert the separating device to block the opening after the container has been loaded with articles, the conveyor may be temporarily reversed to allow insertion of the separating device. Reversal of the conveyor may be under control of a photosensor which detects when a void has been created in the stream of articles. Preferably the opening is closable by means of opposed separating devices having associated bands which have upper runs which may be driven during loading or unloading of the container to move articles away from or towards the opening. The upper runs of the bands are held stationary during insertion of the separating devices.

In a preferred arrangement the container comprises a portable tray which may be moved to and from the loading/unloading position by rotation about an axis parallel to the rod-like articles. The arrangement may be similar to that disclosed in U.S. Pat. No. 4,303,366. The separating devices (and their associated bands) are preferably rotatable about the same axis as the tray.

The invention will be further described, by way of example only, with reference to the accompanying diagrammatic drawings, in which.

Figure 3:
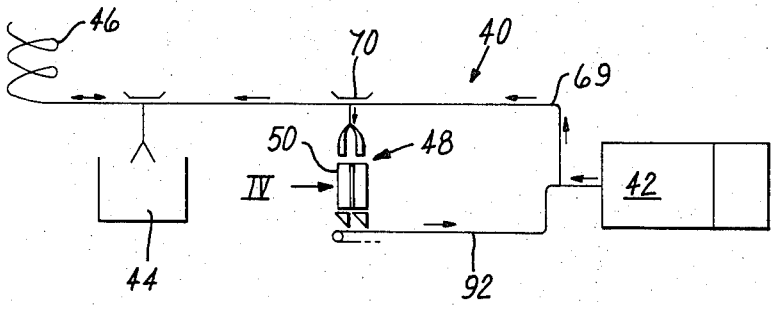
FIG. 3 shows another conveyor system for rod-like articles.
Figure 4:
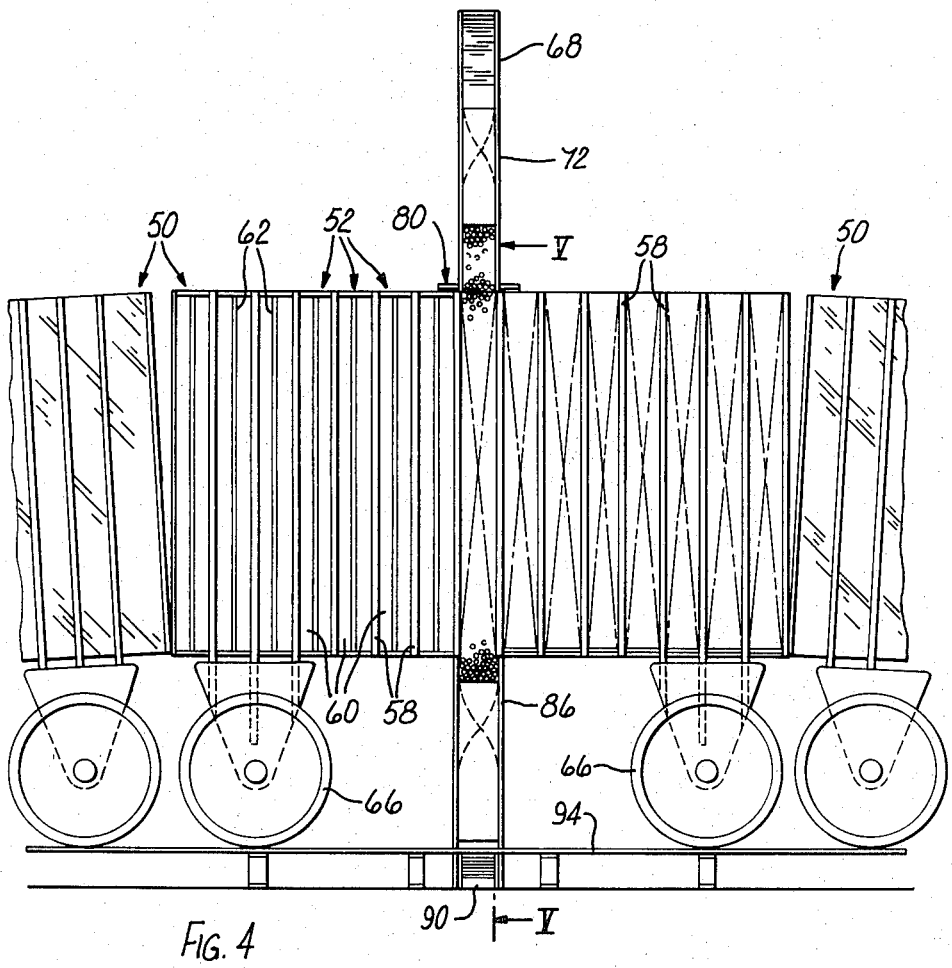
Figure 5:
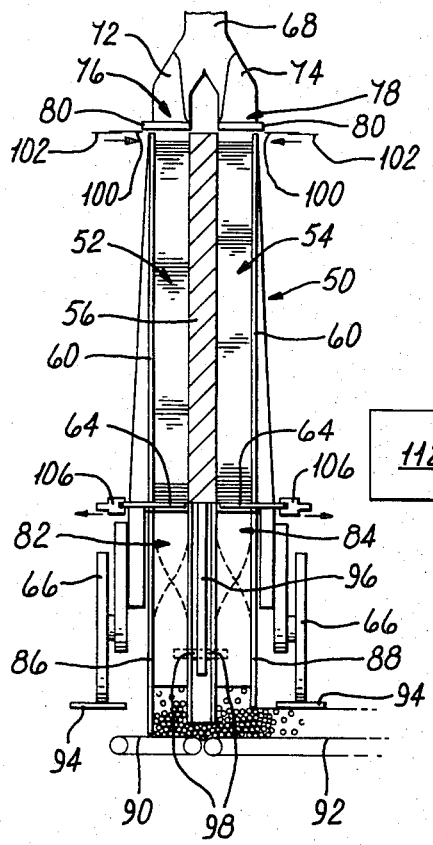
Figure 7:
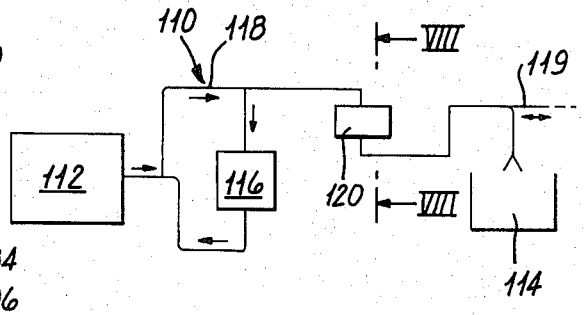
Figure 8:
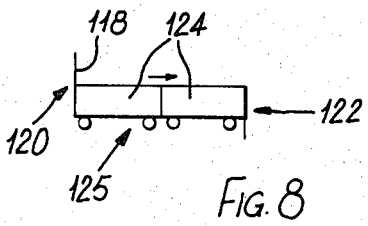
Figure 6:
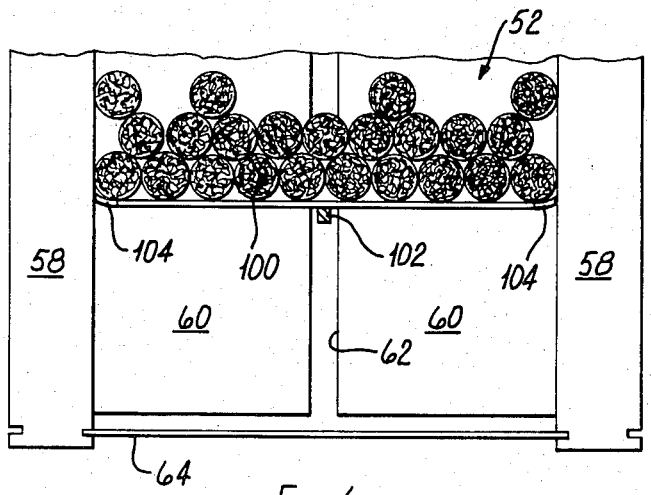
Figure 9:
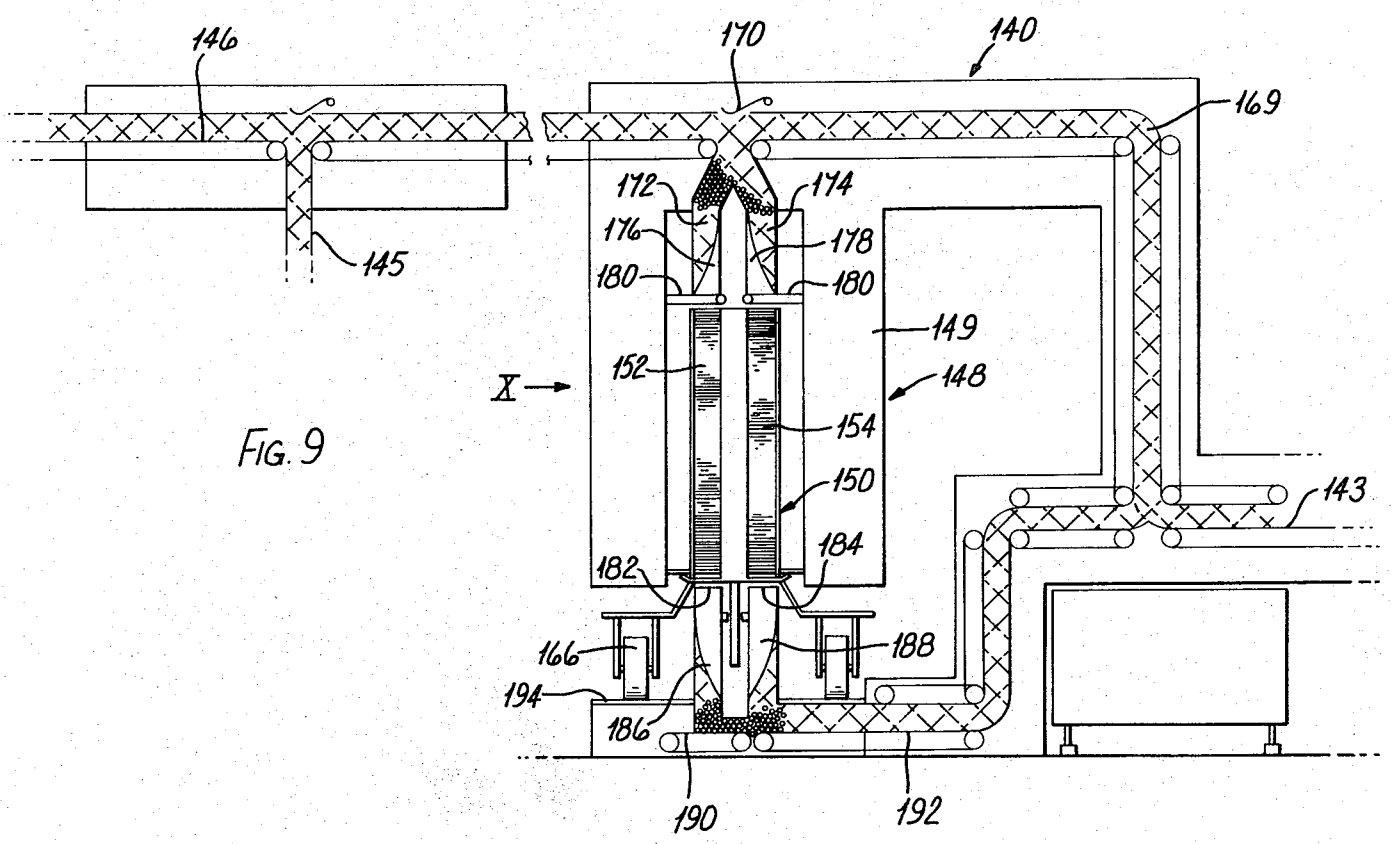
Figure 10:
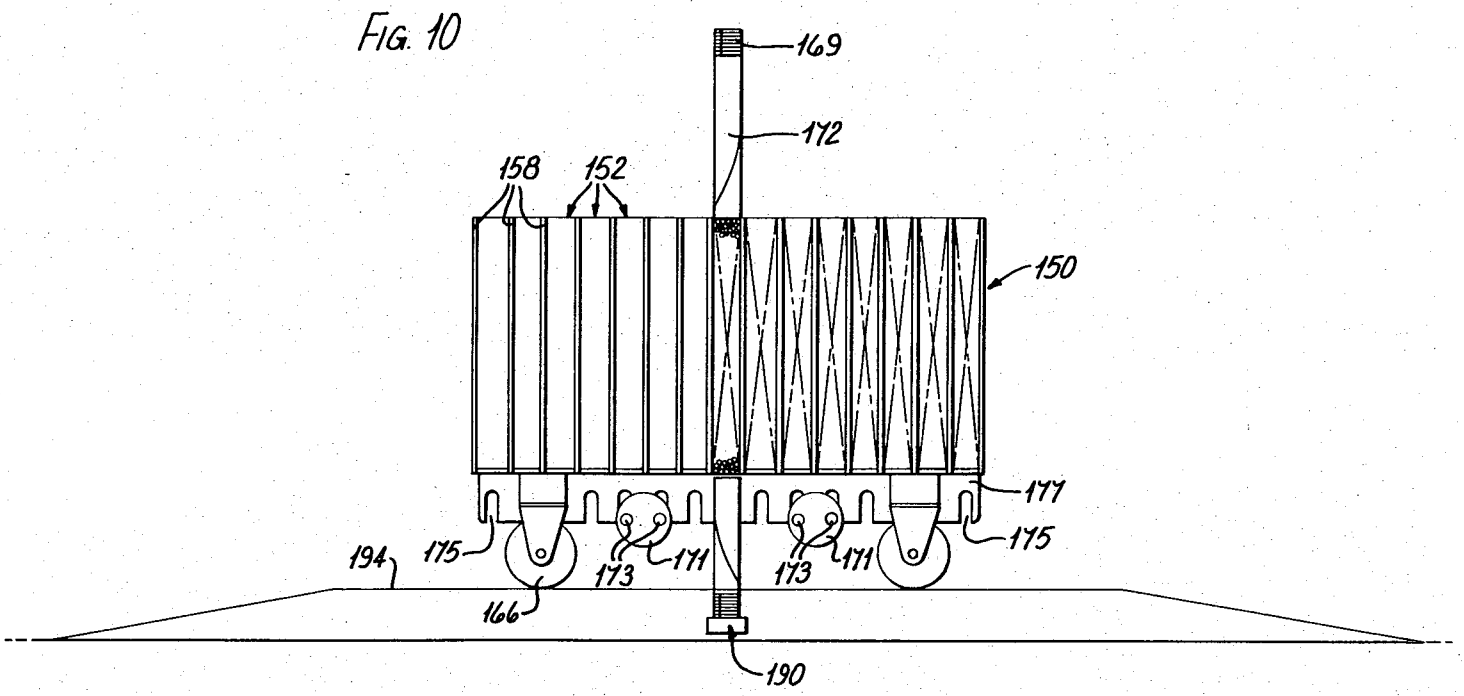
Figure 11:
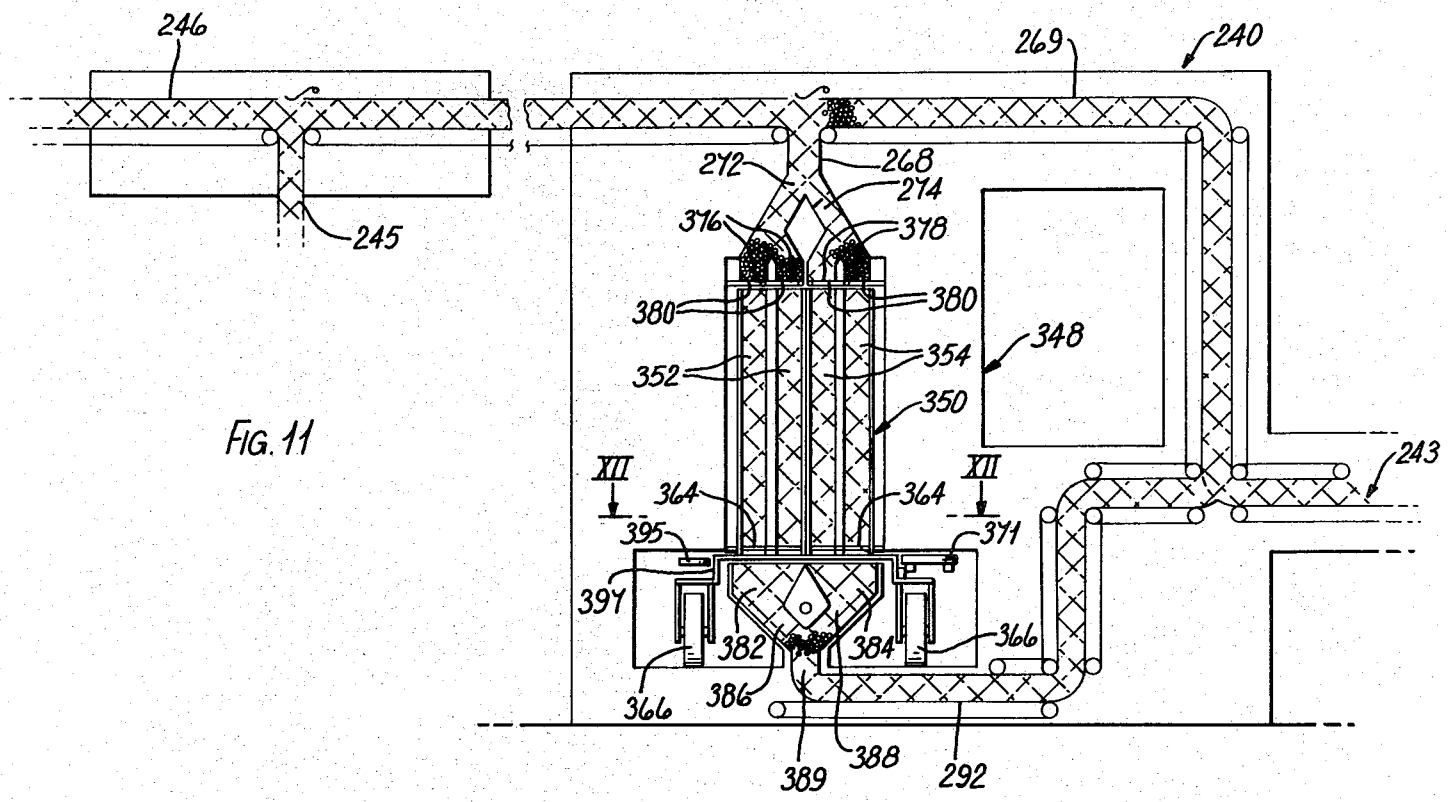
Figure 12:
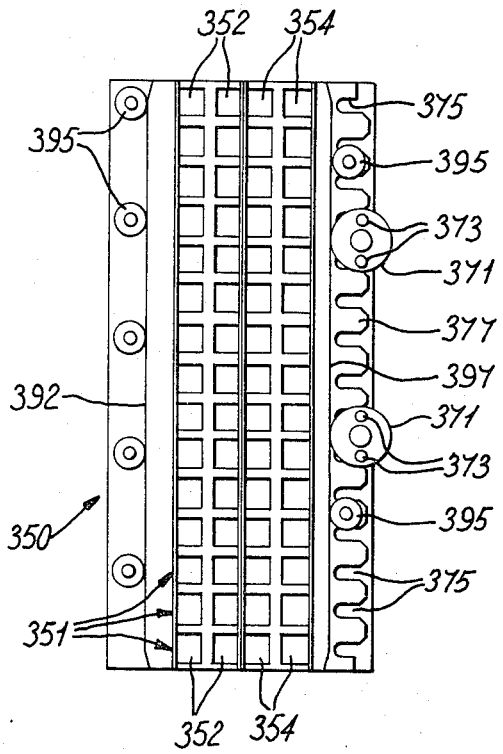
Figure 15:
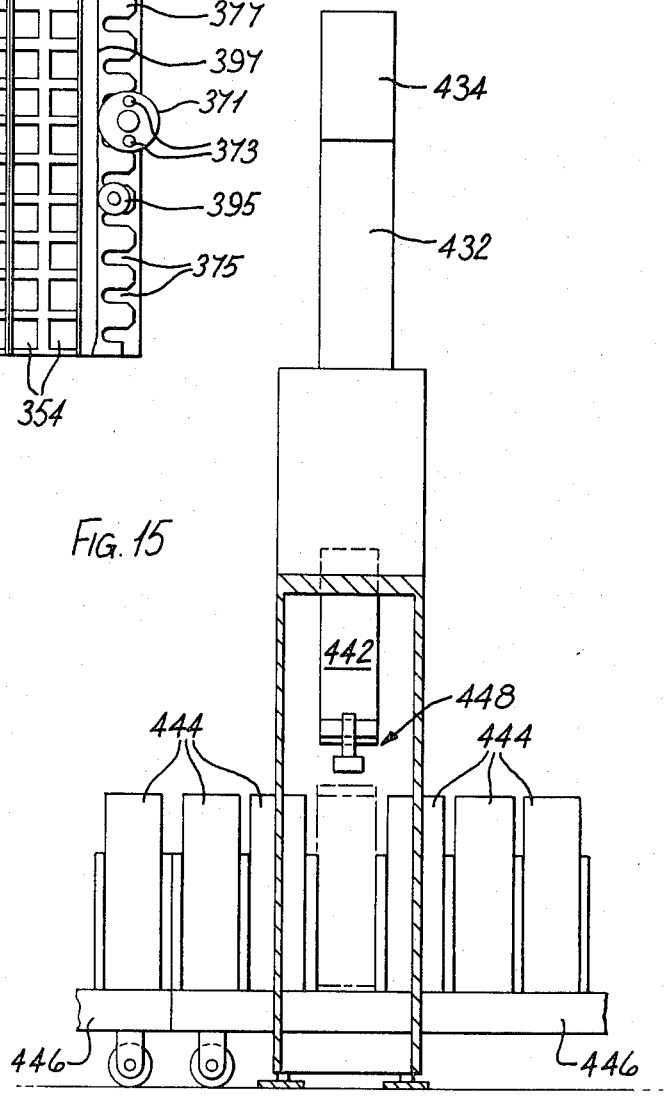
Figure 13:
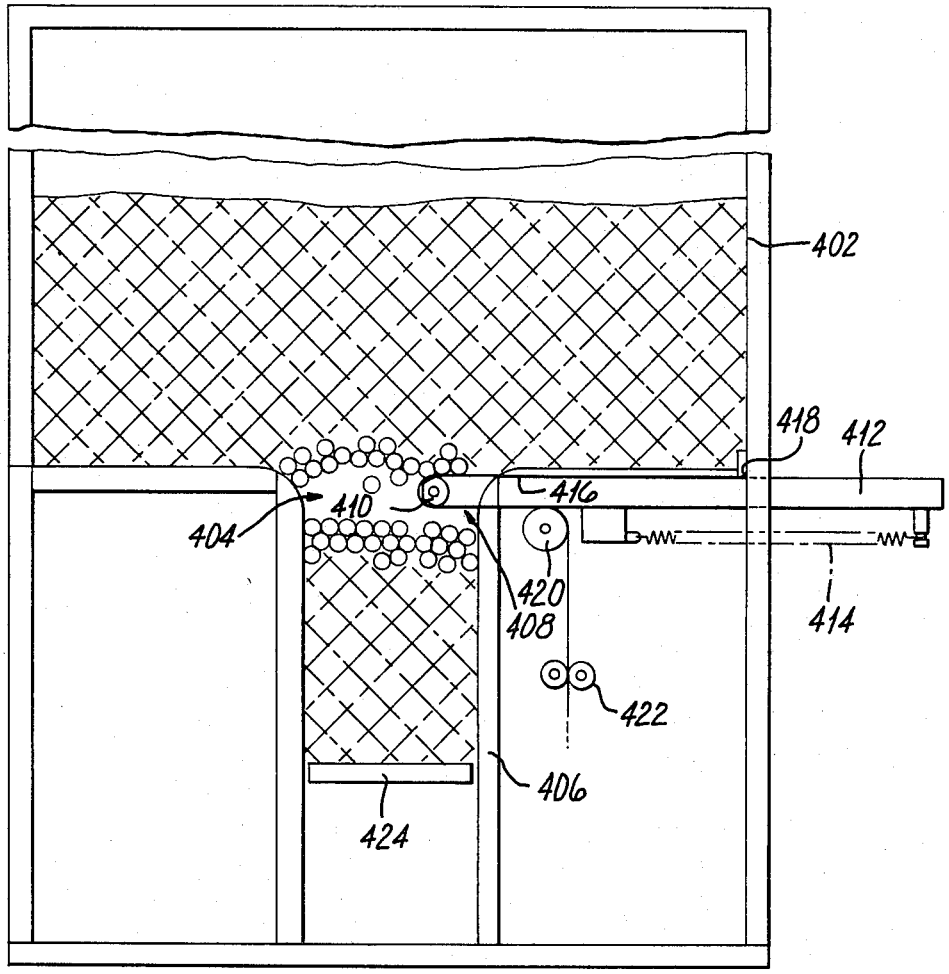
Figure 14:
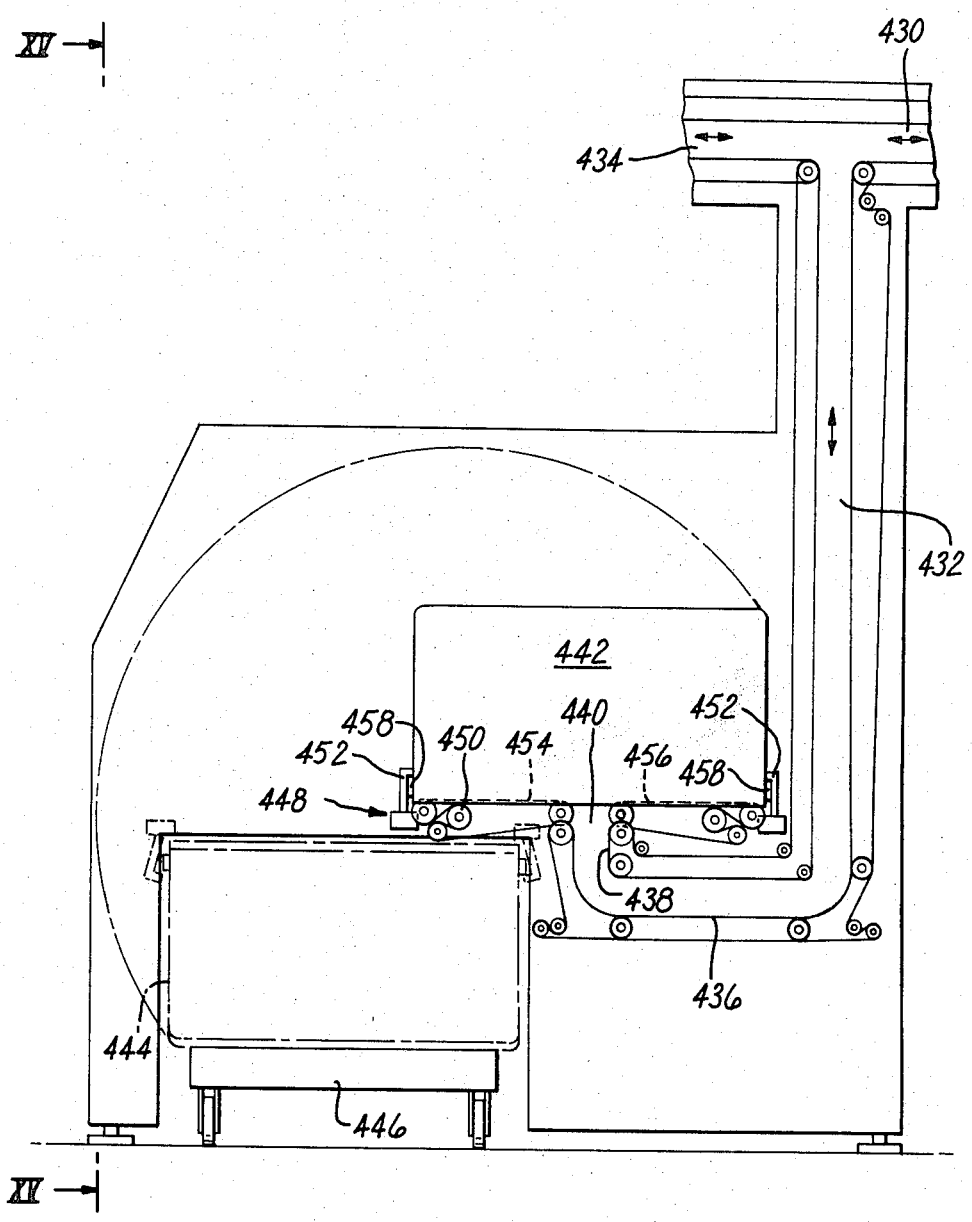
Figure 16:
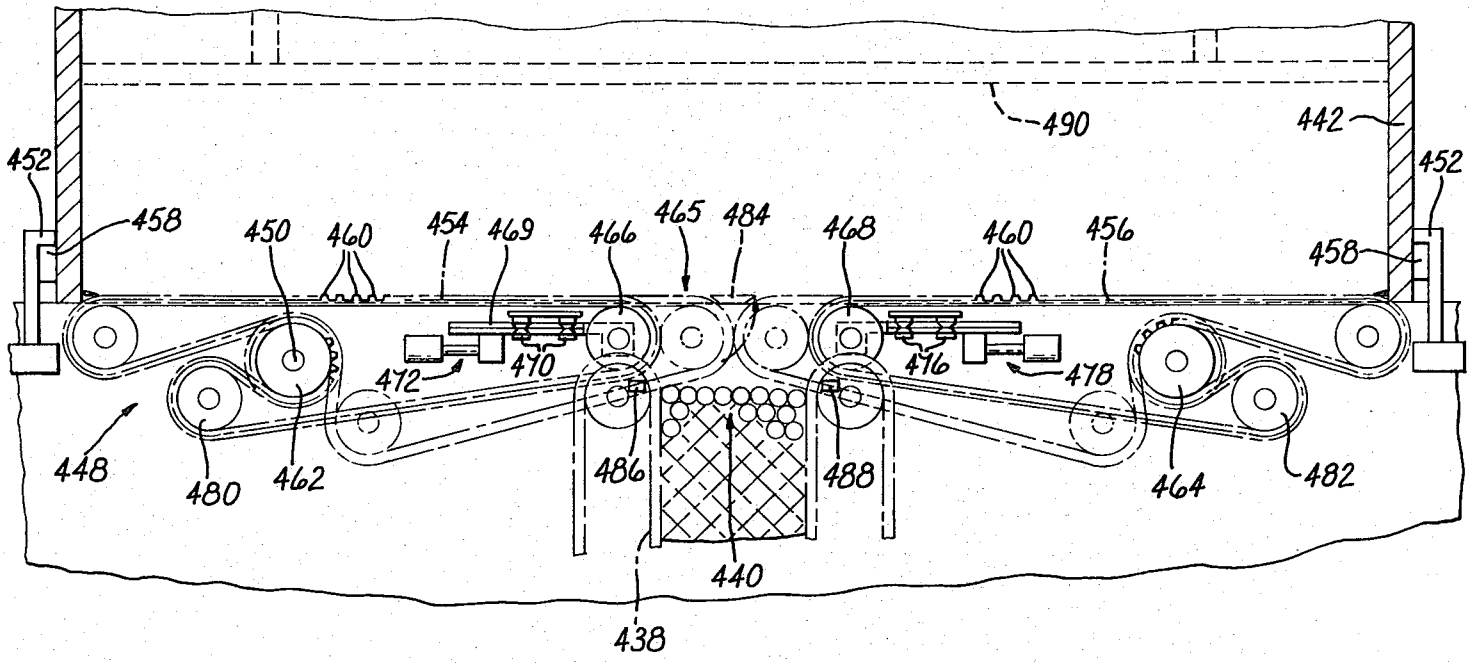
Figure 17:
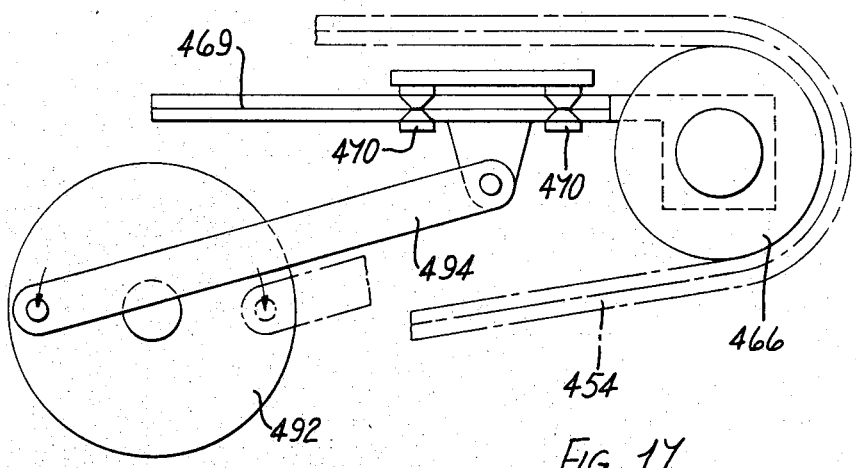
Figure 18:
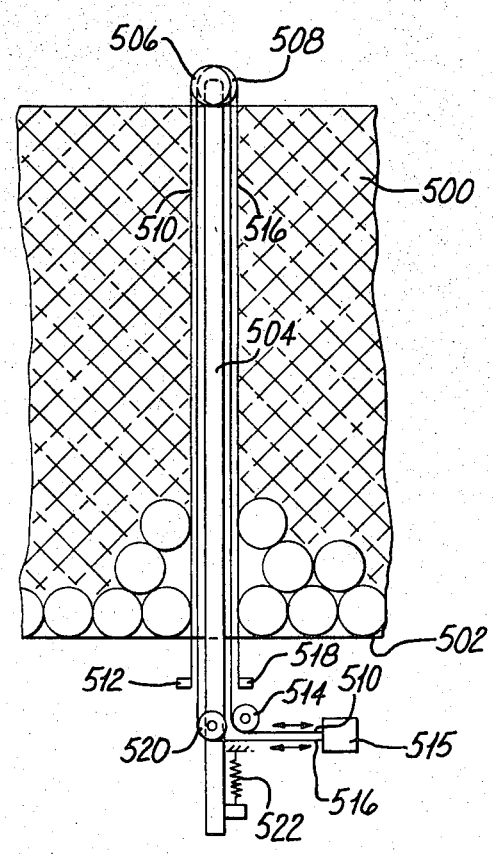

FIG. 4 is an enlarged, part-sectional view of part of the conveyor system in FIG. 3 looking in the direction of arrow IV in FIG. 3, FIG. 5 is a sectional view on the line V—V in FIG. 4, FIG. 6 is a further enlarged view of part of the system shown in FIG. 4, FIG. 7 shows a further conveyor system for rod-like articles, FIG. 8 is a sectional view on the line VIII—VIII in FIG. 7, FIG. 9 is a side view of a still further conveyor system for rod-like articles, FIG. 10 is a view looking in the direction of arrow X in FIG. 9, FIG. 11 is a side view of a still further conveyor system for rod-like articles, FIG. 12 is a sectional view on the line XII—XII of FIG. 11, FIG. 13 is a side view of apparatus for handling rod-like articles, incorporating a gate, FIG. 14 is a side view of tray loading and unloading apparatus, FIG. 15 is a part-sectional view on the line XV—XV of FIG. 14, FIG. 16 is an enlarged side view of part of the apparatus of FIG. 14, FIG. 17 is an enlarged view of a detail modification of the apparatus of FIG. 14, and FIG. 18 is a side view of apparatus for dividing a stream of rod-like articles.

Figure 1:
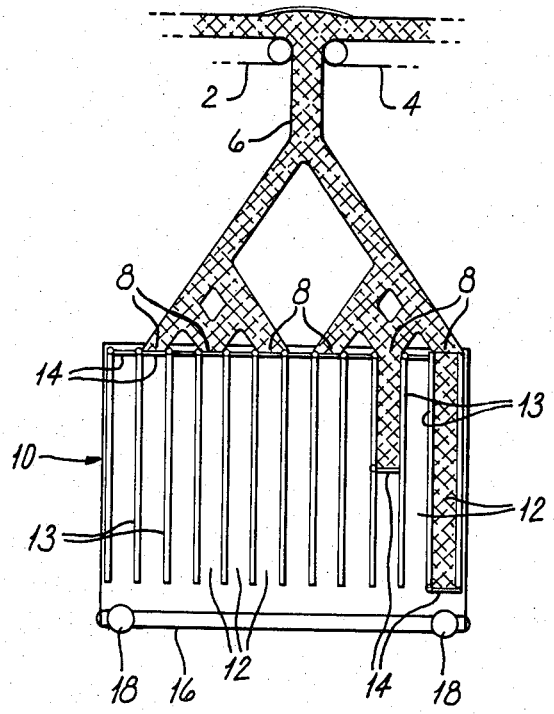
FIG. 1 shows part of a conveyor system for rod-like articles.

FIG. 1 shows a conveyor system including horizontal band conveyors 2, 4 for moving a stream consisting of a stack of rod-like articles in a direction transverse to their lengths. The conveyors 2, 4 define a T-junction with a chute 6 which divides into several branches which terminate in regularly-spaced outlets 8. Each outlet 8 is provided with releasable closure means (e.g. a removable slat or a rolling band closure as described with reference to FIGS. 13–18) for retaining rod-like articles in the branches of the chute 6.

A mobile reservoir 10 adapted to receive stacks of rod-like articles in vertical compartments or columns 12 separated by partitions 13 is positioned underneath the chute 6 so that alternate columns are directly beneath an outlet 8. Associated with each column 12 is a platform 14 for supporting a stack of rod-like articles and means are provided for moving the platform at a controlled rate from an upper to a lower position in its column. An endless band delivery conveyor 16 is spaced below the bottoms of the partitions 13. The reservoir 10 is supported and movable on wheels 18.

In order to fill an empty reservoir 10 with rod-like articles it is first moved into the position shown in FIG. 1, with alternate columns 12 beneath the outlets 8. The conveyor system of which conveyors 2, 4 and chute 6 form a part is operated so that voids do not occur in the stacks of rod-like articles: each of the branches of the chute 6 will therefore contain rod-like articles retained by the closure means for the outlets 8. The platforms 14 in the empty reservoir 10 are at the upper positions so that when an outlet 8 is opened (by release or its closure) the platform directly underneath the outlet takes over in supporting the stack of articles in the above branch of the chute 6. The platform 14 is then lowered in a controlled manner until it reaches its lowermost position where it supports a full column 12 of rod-like articles. The next column 12 is then filled in a similar way, and so on until each of the columns underneath an outlet 8 is filled.

Movement of the platform 14 may be intermittent and will depend on conditions in the conveyor system: the movement may therefore be under the direct control of a sensor in the system, e.g. above the T-junction between conveyors 2, 4 and chute 6. Connection between the sensor and the drive for platforms 14 may be made automatically (e.g. by interconnection of electrical conductors) as the reservoir 10 is moved into position for filling. Alternatively, the drive for platform 14 may be derived from a stationary motor to which the reservoir 10 is connected while it is being filled, the sensor controlling the stationary motor.

The order in which columns 12 are filled is not critical. More than one column could be filled at the same time if required, the speeds of descent of the platform 14 being adjusted so that the supply from the chute 6 is matched and no voids are created.

After one set of columns 12 has been filled the reservoir 10 is indexed, to the right as viewed in FIG. 1, in order to bring the other set of alternate columns into registration with the outlets 8. It will of course be realised that before moving the reservoir 10 each of the outlets 8 must be closed by replacement of the closure means. For example, the closure means can be a thin partition of slat which may be slid into the stack at the bottom of the outlet 8. Movement of the closure means could be by means of pneumatic or hydraulic pistons. Another form of closure means which could be used comprises a rolling band arrangement as described in greater detail with reference to FIGS. 13–18. In this arrangement the closure means comprises a separating device including guide means, such as a pulley, for at least one flexible band and means for holding the upper run of the band stationary as the guide means is projected across the outlet 8. The device preferably includes support means movable with the guide means and arranged beneath the upper run of the band to support it. With any type of closure means it would be possible to arrange for the platform 14 to drop slightly after insertion of the outlet closure so that the columns 12 would not tend to overflow.

The reservoir 10 could hold more than one bank of columns: there could be another row of columns behind the rows shown in FIG. 1. In order to bring these into registration with the outlets 8 it would be necessary to move the reservoir in a direction parallel to the rod-like articles.

Figure 2:
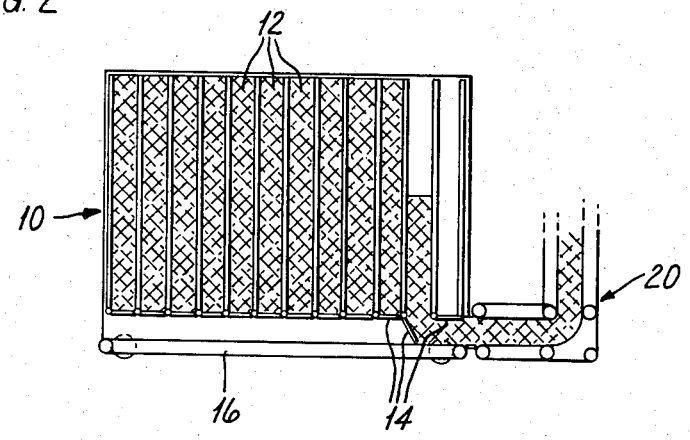
FIG. 2 shows another part of the conveyor system of FIG. 1.

When the reservoir 10 is full it is moved away for storage of the rod-like articles, or for supply to another conveyor system, and is eventually unloaded as indicated in FIG. 2. In its unloading position the reservoir 10 is linked to a delivery conveyor comprising an elevator unit 20. This unit 20 includes an elevator substantially as disclosed in British Patent Specification No. 1,453,191 and modified to include a motor drive output connection as disclosed in German OS No. 2,716,823. This arrangement provides drive for the conveyor 16 and other moving parts of the reservoir 10 when it is connected to the unit 20, by means of engagement of a drive output gear on the unit with an input gear on the reservoir. (A similar drive connection could be used when the reservoir 10 is in its loading position).

As with the conveyor system of FIG. 1 the elevator unit 20 is controlled by sensors (as described for example in British Patent Specification No. 1,372,148) and when the system of which the unit 20 forms a part demands rod-like articles the motor associated with the unit is actuated. This causes operation of the elevator itself and also the conveyor 16 of the reservoir 10. Connections within the reservoir 10 cause successive platforms 14 to hinge downwards and allow the stack of articles in the above column 12 to descend onto the conveyor 16 and be moved away into the elevator into 20. For example, each platform 14 could be hinged at one side about an axis parallel to the articles and held at the other side by a solenoid-operated releasable catch. When a column has been completely emptied the platform 14 is returned to its horizontal position and the next platform is released. Return of a platform to its horizontal position could be caused simply by movement of a stack of articles on the conveyor 16. When all the columns of a reservoir 10 have been unloaded the reservoir can be moved away and replaced by another full reservoir.

The platforms 14 could be cantilevered on pairs of chains arranged adjacent the compartments 12 near the ends of the articles; as previously indicated, the platform could be pivoted on one side and held by a releasable catch on the other side. Alternatively, the platforms 14 could be similarly attached between opposed chains or bands which effectively constitute the partitions 13.

As has already been noted, drive for reservoir functions is required during filling and unloading, and operation of the drive is dependent on conditions within the conveyor system. It may therefore be convenient to provide adjacent chutes 6 and elevator units 20 for a conveyor system so that a reservoir 10 can be brought into simultaneous registration with both the chute and the elevator unit. This allows a single drive unit for control of the reservoir (e.g. the drive connection at the elevator unit) during filling and unloading, and also can provide greater flexibility in allowing relatively rapid switching between filling and unloading, so that the reservoir 10 acts effectively as a removable variable capacity reservoir of the conveyor system.

It is possible that the columns 12 of a reservoir could be filled from a reversible elevator unit 20, such as that shown in FIG. 2. Preferably the partitions 13 would then comprise bands provided with protrusions (as disclosed in British Patent Specification No. 1,453,191) or other ribs or article-engaging means, and would each comprise a small reversible elevator. This elevator could then constitute the support means for a stack within a compartment of the reservoir.

In a possible modification of the reservoir 10 the platforms 14 are supported within the columns 12 during loading and unloading by movable arm assemblies associated with the loading and/or unloading station. When it is required to unload a full column 12 the platform 14 may be withdrawn, in a direction parallel to the lengths of the articles, by the arm assembly. Subsequently the arm returns the platform 14 to the top of the column 12.

In a possible additional modification the conveyor 16 may be provided with spaced cobalt film magnetic strips which support and locate dividers on the conveyor, the dividers being spaced so that they form continuations of the partitions 13 extending between the bottoms of the column 12 and the conveyor. These dividers, together with the platforms 14, may be withdrawn by magnetic latches in sequence at the unloading station to provide successive column unloading. The inlet to the elevator 20 may be similarly provided with a magnetically-releasable gate parallel to the dividers.

Referring now to FIG. 3 a conveyor system 40 is shown linking a machine 42 for producing rod-like articles to a machine 44, such as a machine for packing the articles in the case of cigarettes or a plug shooter in the case of filter plugs. The system 40 includes a reversible reservoir 46 such as Molins OSCAR or MOLAR, to act as a buffer for relatively short-term differences between supply of the producing machine 42 and demand of the packing machine 44. Also forming part of the system 40 is a combined loading and unloading station 48 for trolleys 50.

Referring now also to FIGS. 4 and 5, each trolley 50 consists of two rows of fifteen vertical channels 52, 54 arranged alongside one another on opposite sides of a central plate 56. The channels 52, 54 are respectively separated by partitions 58 which are connected to the plate 56. The sides of the channels 52, 54 opposite the plate 56 are partially closed by pairs of transparent panels 60 separated by a central vertical slot 62. At the bottom of each channel 52, 54 is a removable slat 64. The channels 52, 54 are dimensioned so that they may contain and closely confine a vertical stack of rod-like articles. The trolley 50 is supported on wheels 66.

The loading and unloading 48 includes a chute 68 which branches from the main path 69 of the conveyor system 40 under a sensor 70. The chute 68 divides into two further chutes 72, 74 which respectively twist through 90° in opposite directions as they descend. The outlets 76, 78 of the respective chutes 72, 74 are spaced by the same distance as the rows of channels 52, 54 of a trolley 50. Associated with each outlet 76, 78 is a rolling band closure 80, which comprises at least one band passing around a movable pulley which may be projected across the respective outlet so that the band blocks the path of articles through the outlet. The construction and operation of a closure of this type is described with reference to FIGS. 13–18.

The station 48 further includes spaced inlets 82, 84 located directly below the outlets 76, 78, which inlets lead respectively into chutes 86, 88 which twist through 90° in opposite directions and lead onto stack conveyors 90, 92. As indicated in FIG. 3 the conveyor 92 leads back to the main path 69 of the conveyor system 40.

The outlets 76, 78 and inlets 82, 84 are spaced to allow a trolley 50 to be passed between them so that a channel 52 may extend from the outlet 76 to the inlet 82 and a channel 54 may extend from the outlet 78 to the inlet 78. In this position the trolley wheels 66 are supported on a raised floor level 94, and a guide rail 96 connected to the central plate 56 passes between stationary guide rollers 98.

The trolley 50 operates as a removable reservoir for rod-like articles in the conveyor system 40. When differences between supply from the producing machine 42 and demand from the packing machine 44 are such that the reservoir 46 cannot cope, the loading and unloading station 48 for trolleys 50 may be brought into operation. If supply exceeds demand articles may be loaded into trolleys 50 by diverting part or all of the flow of articles on the main path 69 into the chute 68. If demand exceeds supply then articles are unloaded from a trolley 50 at the station 48 and are supplied via chutes 86, 88 and conveyor 90, 92 to a junction with the main path 69 for conveyance to the packing machine 44. The trolley 50 containing rod-like articles may have been previously loaded with articles at the station 48 when supply exceeded demand, or loaded at a different station, which may be in a different conveyor system.

When the conveyor system 40 is operating to load a trolley 50 with rod-like articles, the channels 52, 54 are filled in pairs, together. The filling of each channel 52, 54 is the same, the channel 52 being filled from the outlet 76 and the channel 54 from the outlet 78. The filling of a channel 52 will be described. Just before filling starts the closure 80 is in its closed position so that a stack of articles is held in the chute 72 above the outlet 76. An article lowering plate 100 (FIG. 6) attached to an arm 102 which is connected to drive means within the loading/unloading station 48 is inserted just above the tops of the transparent panels 60 by outward movement of the arm 102, in a direction parallel to the articles, to lie just below the closure 80 at the top of the channel 52. Subsequently the closure 80 is opened and the articles in chute 72 are then supported on the platform 100. The drive means within the station 48 lowers the arm 102, and with it the platform 100, to allow the articles to progressively fill the channel 52. As the platform 100 is lowered flexible ends 104 wipe along the partitions 58. At the bottom of the channel 52, the platform 100 and arm 102 are withdrawn between the bottoms of the panels 60 and the slat 64, the articles in the channel 52 thereafter being supported on this slat.

Shortly before the platform 100 reaches the position at the bottom of the channel 52 and while it is still moving downwards, the closure 80 for the outlet 76 is actuated to return to its closed position. Movement of the closure 80 to this position is thereby facilitated since the articles in the channel 52 are still moving downwards so that a partial void or at least loosening of the articles occurs to allow the closure to enter the stack. After the platform 100 and arm 102 have been withdrawn they are moved rapidly upwards by the drive means for reinsertion beneath the outlet 76. At the same time the trolley 50 is indexed one pitch to move the next empty channel 52 (and 54) into position for filling. A suitable trolley moving and indexing arrangement is described in British Patent Specification No. 1,117,236.

The downward movement of the platform 100 and arm 102 is at a controlled speed which depends on the rate of supply of articles into the chute 68. The withdrawal, upward return, and reinsertion of the platform 100 is preferably as rapid as possible (although this need not be critical if more than one platform 100 and arm 102 is used.) The required movement of the platform 100 can be obtained by means of a pair of parallel drive chains following a rectangular path and connected by a link attached to the arm 102. For example, the arrangement may be somewhat similar to that for moving the arm 52 in British Patent Specification No. 1,532,422 or the pusher 46 in the aforesaid U.S. Pat. No. 4,303,366. Another possible arrangement including a reciprocating drive member and cam means for projecting and retracting a feed member movable with the drive member is disclosed in connection with FIGS. 9 to 11 of the aforesaid U.S. Pat. No. 4,303,366. Alternatively the required movement could be achieved by pneumatic or hydraulic piston and cylinder assemblies acting at right angles.

Accurate registration between the station 48, which includes outlets 76, 78, platform 100, and inlets 82, 84, and the trolley 50 is important. For this reason the trolley 50 is provided with a guide rail 96 which is guided between rollers 98 at the station 48 to centralise the trolley. Some tolerance in the longitudinal positioning of the trolley is provided by the flexible ends 104 of the platform 100, although the arm 102 must pass through the slot 62 which is preferably of lesser width than an article diameter. It is possible to provide additional tolerance for slight longitudinal misalignment of a trolley by arranging for the outlets 76, 78, channels 52, 54 and inlets 82, 84 to be of slightly increasing width. Thus, the width of the outlets 76, 78 (as viewed in FIG. 5) may be 95 mm, that of the channels 52, 54, 100 mm and that of the inlets 82, 84, 105 mm.

When it is required to unload articles from a trolley 50, the latter is moved until a pair of channels 52, 54 containing articles is positioned over the inlets 82, 84. The closures 80 for the outlets 76, 78 remain closed. The combined loading/unloading station 48 contains gripping fingers 106 which are actuable to engage and remove the slats 64 by movement in a direction parallel to the articles in the channels 52, 54, as indicated in FIG. 5. On withdrawal of the slats 64 the articles in the channels 52, 54 fall a small distance onto articles already in the chutes 86, 88 just below the inlets 82, 84. The chutes 86, 88 twist the articles so that they are orientated in the same way as in the main path 69 and lead to a combined stack on the conveyor 92. This conveyor 92 returns articles to the main path 69. The short conveyor 90 feeds articles from the chute 86 onto the conveyor 92. Preferably the conveyor 90 is controlled by the level of articles in the chute 88, being switched on and off by a photosensor in this chute, for example.

When the channels 52, 54 are empty, as determined by photosensors at the inlets 82, 84 for example, the slats 64 are returned by the fingers 106. The level of articles in the channels 52, 54 could be sensed by means of a movable sensor plate similar to that disclosed in British Patent Specification No. 1,339,887. A modified platform 100 used for loading of the chutes 52, 54 could possibly also be used as a sensor plate for use during unloading.

The conveyor system 40 may be controlled by reference to the reversible reservoir 46. This may have a neutral or median position at about half maximum capacity and the system 40 may be controlled to keep or tend to keep the reservoir at this position as far as possible. Thus, if the reservoir 46 reaches a high limit switch which is positioned near full capacity (but allowing some safety margin) loading at the station 48 will be initiated and will continue until the reservoir 46 returns to its neutral position. Similarly if the reservoir 46 reaches a low limit switch near its minimum capacity unloading at the station 48 will be initiated and will continue until the reservoir is returned to neutral. The loading and unloading cycles at the station 48 may in addition or independently be controlled in response to stoppage of the packing machine 44 and producing machine 42, respectively.

As indicated in FIG. 4, trolleys 50 are moved in substantial abutment through the loading/unloading station 48. The end partitions 58 of each trolley 50 are half the width of the intermediate partitions, so that the channels 52, 54 are equally spaced in an abutting line of trolleys. The movement of the trolleys 50 through the station 48 is reversible so that channels 52, 54 can be loaded during movement in one direction and unloaded during movement in the opposite direction. Reversal between loading and unloading can take place within the same trolley 50, but once loading or unloading of a pair of channels 52, 54 has commenced, this is completed. The trolleys 50 may be moved by indexing means, as previously indicated. Alternatively the trolley 59 could be self-powered.

Typically each trolley 50 may be about 1800 mm long and 900 mm high. This gives a capacity, with rod-like articles of about 8 mm diameter, such as cigarettes or cigarette filter rods, of about 1500 articles per channel 52, 54, or 45000 per trolley 50.

When the rod-like articles conveyed within the system 40 are filter cigarettes, the latter are preferably loaded into the trolley channels 52, 54 with the filter tip ends of the cigarettes adjacent the central plate 56. Since there is a tendency for such cigarettes to maintain a slightly higher average diameter at their filter tip ends than at the tobacco ends it may be preferable to provide some tip compensation in the channels 52, 54 by making the partitions 58 slightly wider at their outer ends than at the ends attached to the plate 56, so that the width of a channel reduces slightly away from the plate.

Another conveyor system 110, particularly for linking a machine 112 for producing filter rod-lengths to a pneumatic distribution unit 114, such as Molins APHIS, is shown in FIGS. 7 and 8. In the system 110 a loading-/unloading station 116, basically similar to the station 48. is provided as before. In addition, however, the main path 118 of the system 110 is provided with spaced loading and unloading stations 120, 122, respectively, for trolleys 124. A reversible reservoir 119, such as Molins MOLAR or OSCAR is connected to the path 118. The loading and unloading stations 120, 122 are similar to the respective parts of the combined loading station 48 but are spaced apart so that there is a trolley path 125 between them. The trolleys 124, which may be identical to the trolleys 50, are filled and unloaded in the same way as the trolleys 50. The difference in this part of the system 110 is that all the articles passing along the main path 118 are first loaded into a trolley 124 at the loading station 120 and then unloaded at the unloading station 122 after passing along the path 125, and that the trolleys 124 run only in one direction. The passage of each article from the machine 112 to the unit 114 is therefore delayed, since the movement along the path 125 of the trolleys 124 each of which may hold about 45,000 articles, is relatively slow. The trolley path 125 therefore constitutes a delay line in the path 118. In the system 110, for example, the delay line comprises about two complete trolleys 124 and therefore holds about 90,000 articles. As is well known, the use of such a delay line in a system for transporting filter rod lengths from a producing machine 112 is to provide the curing time necessary for certain types of such rod lengths.

The delay line itself could perform the function of the reservoir for the system 110, if required, making the station 116 and its associated by-pass unnecessary. It would then be necessary to move the trolleys 124 in reversible directions between the stations 120 and 122. One possible disadvantage would be that when the unit 114 was re-started after a temporary shut-down a partly-filled trolley 124 would probably remain to the right of the station 122.

FIGS. 9 and 10 show a system 140 which is very similar to that of FIGS. 3 to 6; parts which are similar are referenced by the numbers of the corresponding parts in the system of FIGS. 3 to 6 increased by 100. In the following description only additional points and points of difference will be described.

The main path 169 links a stack conveyor 143 which receives rod-like articles from an article producing machine to a chute 145 which leads to an article packing machine. The various drive means at the loading/unloading station 148 are contained within a housing 149 which forms a tunnel through which the trolley 150 is moved. As shown in FIG. 10, the trolley 150 is indexed by a pair of rotary drive members 171 each of which carries projecting pegs 173 which are engaged in slots 175 in a depending rail 177 attached to each trolley 150. The arrangement is basically similar to that disclosed in British Patent Specification No. 1,117,236.

FIGS. 11 and 12 show a further conveyor system 240 for use with modified trolleys 350. The system 240 is generally similar to the systems 40 and 140 of FIGS. 3 to 6 and FIGS. 9 and 10 respectively; parts which are similar are referenced by the numbers of corresponding parts in the systems 40 and 140 increased by 200 and 100 respectively. Only additional points and points of difference will be described below.

Each trolley 350 has fifteen rows 351 each of four vertical channels 352, 354. The station 348 is adapted to load or unload all the channels 352, 354 of a row 351 at the same time. The chute 268 branches once into chutes 272 and 274 each of which branches again into pairs of outlets 376 and 378 respectively. Each outlet 376, 378 is provided with closure means 380 operable to close the outlets together. Combined inlets 382 and 384 receive the articles from the channels 352, 354, respectively and lead to a combined chute 389 and conveyor 292. The bottoms of the channels 352, 354 are closable by slats 364.

One important difference in the system 240 which should be noted is that the articles do not have to pass through a twisted chute in order to enter the trolley 350 and, correspondingly, they are not twisted before return to the conveyor 292. This is possible since the articles are stored in the channels 352, 354 parallel to the direction of movement of the trolley 350. This has the further advantage that withdrawal of the slats 364 is transverse to the articles in the channels 352, 354. Also, the platform corresponding to the platform 100, for supporting a descending stack of articles in the channels 352 or 354, need not extend for the full width of the channel since it need only support the bottom row of articles at appropriately spaced locations relative to the article length.

Movement of the trolleys 350 is basically as before except that the spaced rotatable drive members 371 are rotatable about vertical axes and carry pegs 373 which engage in slots 375 formed in a horizontally extending channel 377 attached to the trolley 350. The trolley 350 is guided by means of stationary rollers 395 which engage a vertical panel 397 just above the trolley wheels 366.

Apart from advantages which arise as a consequence of storing the articles parallel to the direction of movement of the trolley 350, a further significant advantage is that the trolley 350 can hold twice as many articles as a trolley 50 or 150 without significantly increasing problems of storage and conveyance of the trolley itself.

FIG. 13 shows apparatus for handling rod-like articles, including a container 402 having an outlet 404 leading to a chute 406. The outlet 404 is closable by means of a gate, generally indicated at 408. The gate 408 comprises a pulley 410 mounted on a horizontally-slidable support 412 which is biased by a tension spring 414 towards a position at which the support extends across the outlet 404. A band 416 fixed at one end 418 passes over the support 412, around the pulley 410, and around a further pulley 420 to reversible drive means 422. A platform 424 for supporting rod-like articles is reversibly movable in the chute 406.

The gate 408 can be operated to block the outlet 404 and isolate the articles in the container from those in the chute 406. For example, when articles are passing out of the container 402 through the chute 406, e.g. by controlled descent of the platform 424, the drive means 422 may be actuated to release the band 416 at a controlled speed. This allows the tension spring 414 to advance the support 412 and pulley 410 across the outlet 404. As the pulley 410 advances minimal disturbance is caused to the articles in the container 402 since the upper run of the band 416 (which covers, or at least shields, the support 412) remains stationary. When the gap across the outlet 404 has been reduced to a critical width, which depends on the diameter and nature of the articles, lateral "bridging" of the articles may occur (as indicated in the drawing). Further passage of the gate 408 across the outlet 404 does not disturn this "bridge", again because of the stationary upper run of the band 416. If there is any tendency for an article to remain in the path of the gate 408 as it nears the opposite side of the outlet 404 the movement of the band 416 around the pulley 410 tends to displace the article upwards out of the path of the gate so that it will not be crushed. In order to aid insertion of the gate 408, the platform 424 may be arranged to continue its descent in the chute 406 for a short period after insertion of the gate has started. Once the "bridging" effect referred to above has occurred further descent of the platform 424 is unnecessary.

The gate 408 is also usable to isolate the container 402 after being supplied with articles through the chute 406, e.g. by upward movement of the platform 424. In this case the movement of the platform 424 may be reversed for a short period during initial insertion of the gate 408.

The gate 404 is removed to open the outlet 408 by operating the drive means 422 to move the band 416 so that the pulley 410 and support 412 are withdrawn against the tension of spring 414.

The gate 408 could be moved by direct action on the support 412, e.g. by means of a pneumatic piston, in conjunction with tensioning means for the band 416, instead of by the spring 414 and drive means 422 for the band.

A gate similar to the gate 408 could be used to close the outlet 8 in FIG. 1, or as the closure 80 in FIG. 4, 180 in FIG. 9, or 380 in FIG. 11.

The tray loading and unloading apparatus shown in FIGS. 14 to 16 comprises conveyor means 430 for delivering a stack of rod-like articles to a junction with a stack elevator 432. A reversible reservoir conveyor section 434 also connects with the junction. The elevator 432 leads down to a short horizontal conveyor section 436 beyond which is a further elevator 438. The conveyors and elevators 430–438 comprises opposed laterally spaced bands (which may be provided with spaced protrusions). The construction and operation of an elevator for a stack of rod-like articles is described and illustrated in British Patent Specification No. 1,453,193. The elevator 438 terminates at an outlet 440 over which a tray 442 may be inverted for loading or unloading.

Trays 444, similar to the tray 442, are delivered to and removed from the apparatus on trolleys 446 which move on a path generally parallel to the articles in the elevator 438. Trays 444 are moved to and from the loading/unloading position of the tray 442 by means of a support assembly 448 which is rotatable about an axis 450. The assembly 448 includes a pair of latches 452 and also carries bands 454, 456. The latches 452 are pivotable to engage lugs 458 on each side of a tray 442, 444, and also movable upwards relative to the support assembly 448, so that when the assembly is positioned above a tray 444 on a trolley 446 the tray may be lifted clear of the trolley and clamped to the assembly. The required movement of the latches 452 could be achieved by means of air cylinders and/or cam means. The slight lifting of the tray 444, indicated by chain dot lines in FIG. 14, allows the assembly 448 to rotate about the axis 450 while carrying the tray and ensures that the latter will clear the trolley 446 during rotation. The support assembly 448 thus moves a tray 444 from a trolley 446 into the position of tray 442 for loading or unloading. After the tray 442 has been loaded or unloaded it is returned by reverse rotation of the support assembly 448 and released by the latches 452 for delivery onto the trolley 446.

The trolley 446 is indexed one position forwards or backwards (normally depending on whether the apparatus is in a loading or unloading mode) to bring another tray into alignment with the support assembly 448. One form of suitable trolley-indexing mechanism is described and illustrated in British Patent Specification No. 1,117,236. As indicated in FIG. 15 successive trolleys 446 may be moved in abutment so that the spacing between trays 444 is constant. The trolleys 446 may be maintained in abutment and correctly oriented by means of magnets of opposite poles at the front and rear of each trolley. Aligning means comprising pegs and sockets may be used to provide lateral positioning of the trolleys 446 relative to one another.

The loading and unloading of a tray 442 will be described with particular reference to FIG. 16. The tray 442 is clamped to the support assembly 448 by latches 452, and is located just above the outlet 440 of the elevator 438. The bands 454, 456 are positioned beneath the open top of the inverted tray 442. For convenience each band 454, 456 will be referred to as a single band but in fact the bands 454, and 456 each comprise a pair of laterally spaced bands located just inside the planes of the laterally spaced bands of the elevator 438. The bands 454, 456 (and also the bands of elevator 438) are formed with molded teeth 460 which serve to engage with respective drive pulleys 462, 464 for the bands, and also to provide additional driving contact between the bands and the rod-like articles. For the latter purpose the recesses between the teeth 460 are preferably of appropriate size to seat a single rod-like article.

In the region just above the outlet 440 the bands 454, 456 pass around respective pairs of confronting pulleys 466, 468 which, in the position shown in full lines in FIG. 16, define an opening of about the same width as the outlet 440. As explained below this opening may be closed by a gate indicated generally at 465 and including the pulleys 466, 468. The pulleys 466 are rotatably mounted on a slide 469 which is adapted to run in pairs of V-groove rollers 470 (only one pair of which is shown in the drawing). The position and movement of the slide 469, and therefore of the pulley 466, is controlled by a pneumatic piston assembly 472. Similarly, the pulleys 468 are mounted on a slide 474 movable relative to rollers 476 by a piston assembly 478. The pulleys 466 and 468 are movable under action of the respective piston assemblies 472, 478 between the position shown in full and dotted lines in FIG. 16, i.e. between open and closed positions of the gate 465 respectively. In order to accommodate the movement of the pulleys 466, 468 the bands 454, 456 pass around tensioning pulleys 480, 482 which are pivotally movable about the axes of drive pulleys 462 and 464 respectively, as indicated in FIG. 16.

There is still a slight gap between the upper runs of the bands 454, 456 when the pulleys 466, 468 are closest to one another. A pivoted bridge piece 484, movable as indicated in the drawing as the pulleys 466, 468 move together (e.g. by cam means synchronised with the piston assembly 472) is provided for filling this gap.

A light source 486 and photo-detector 488 are positioned on opposite sides of the outlet 440 just below the gate 465.

When the apparatus is used as a tray unloader a full tray on the trolley 446 is picked up by the support assembly 448 and rotated with it about the axis 450 to the position of the tray 442 in FIG. 16. Prior to and during rotation of the assembly 448 the gate 465 is closed so that the pulleys 466, 468 are in their positions of closest proximity and the bands 454, 456 and bridge piece 484 close the open top of the tray. After rotation of the tray and assembly 448 the pulleys 466, 468 are moved apart and the bridge piece 484 pivoted away, thereby opening the gate 465. Subsequently, the bands 454, 456 are driven by their respective pulleys 462, 464 so that their upper runs move towards one another and articles in the tray 442 are moved towards and through the open gate 465 and into the outlet 440. The elevators 438 and 432 and conveyors 436 and 430 are driven to move articles away from the unloading tray 442. Drive of the bands 454, 456 and the elevator 438 etc. continues until the detector 488 in the outlet 440 is uncovered, thereby indicating that the tray 442 is empty. It is desirable to speed up the bands 454, 456 when the tray is about three-quarters empty, to move articles more rapidly towards the central opening of the gate 465 to prevent a void forming in this region.

When the tray is empty the pulleys 466, 468 are moved together to close the gate 465 and the tray 442 is returned to the trolley 446 and released by the assembly 448. Assuming that the apparatus is still required to unload trays, the trolley 446 is then indexed one position to move the next full tray into place for pickup by the assembly 448.

When the apparatus is used as a tray loader an empty tray is picked up by the assembly 448 and moved to the position of the tray 442 in FIG. 16. As before, the pulleys 466, 468 are adjacent during movement of the assembly 448 and are subsequently moved apart (and the bridge piece 484 pivoted away) to open the gate 465. During loading, the bands 454, 456, elevators 438 and 432, and conveyors 430 and 436 are driven to move articles to and through the outlet 440 and into the empty tray 442. The movement of the upper runs of bands 454, 456 away from one another causes the articles to spread out within the tray.

The bottom of each tray 442, 444 is provided with a slot to provide access for a sensor bar, indicated at 490 in FIG. 16, which is attached to mechanism within the apparatus and is arranged to rest lightly on the top layer of articles as the tray is filled. The bar 490 follows the upward movement of the articles in the tray and helps to maintain the upper surface level. When the bar 490 reaches an upper limit position, indicating that the tray is full, it is withdrawn upwards through the slot and the band 454, 456 and elevator 438 etc. are stopped. The sensor bar 490 can also be used during unloading when it can help keep the descending surface of the articles level and indicate when it is necessary to speed up the bands 454, 456. The construction and use of a sensor bar is described and illustrated in British Patent Specification No. 1,339,887.

After the bands 454, 456 and elevator 438 etc. have been stopped when the tray 442 is full, the pulleys 466 and 468 are advanced towards one another in order to close the gate 465. At the same time the elevator 438, conveyor 436 and elevator 432 are driven to move articles away from the outlet 440, this creating a void to allow entry of the pulleys 466, 468. The reversible reservoir 434 accommodates this reverse flow of articles. The reverse movement of the elevator 438 etc. continues until light from the source 486 reaches the photocell 488. This ensures a loosening of the articles in the region above the outlet 440 to allow the pulleys 466, 468 to move towards one another. As with the embodiment of FIG. 13, once the pulleys 466, 468 are sufficiently close together, the articles "bridge" the gap naturally and a void is created below the pulleys. It is at this stage that the reverse flow of the elevator 438 etc. will normally stop. The pulleys 466, 468 can then advance freely to completely close the gate 465 (together with the bridge piece 484). The upward movement of the bands 454, 456 around the pulleys 466, 468, respectively, helps to prevent any article becoming trapped between the pulleys. Since the upper runs of the bands 454, 456 remain stationary during movement of the pulleys 466, 468 there is minimum disturbance to the articles in the tray 442.

Once the gate 465 has been closed the assembly 448 may be rotated about its axis 450, in order to return the tray 442 to the trolley 446. The trolley 446 may then be indexed to position another empty tray under the support assembly 448, for clamping to the assembly and subsequent rotation to the loading position.

The conveyor 430 may form part of (or be connected to) a conveyor system linking one or more article producing machines (e.g. cigarette making machines) to one or more article receiving machines (e.g. cigarette packing machines). The apparatus can operate as a tray loader or as a tray unloader as necessary according to conditions in the conveyor system (as indicated by the producing and receiving machines). If necessary the apparatus can reverse between its tray loading and tray unloading modes during operation on one tray. The trolleys 446 are preferably movable so that, referring to FIG. 15 for example, full trays are always to the left of the apparatus and empty trays to the right. The trolleys 446 will then be moved in a direction, which depends on the mode of operation of the apparatus, to deliver empty or full trays to the support assembly 448.

Instead of using a bridge piece 484 to close the slight gap between the upper runs of bands 454, 456, the bands and their respective pulleys 466, 468 can be offset so that the bands can overlap when the gate 465 is closed, so that the upper runs of the bands close the gap. For example, the pulleys 466, 468 could be moved towards one another to a position at which their axes are aligned. Alternatively the pulleys 466, 468 could be at different levels so that they can overlap. In this case the gap between the lower run of the upper band and the upper run of the lower band is preferably about one article diameter; this should avoid any possible damage to articles as the gate is closed.

Another possible modification of the apparatus of FIGS. 14 to 16 is that one or both of the side conveyors of elevator 438 could be arranged to be movable sideways slightly, to increase the width of the elevator just below the outlet 440 so as to create the necessary void to allow entry of the pulleys 466, 468 during closing of the gate 465 after a tray 442 has been filled. If the apparatus is provided with this modification reversal of the elevator 438 etc. to allow entry of the pulleys 466, 468 is unnecessary.

A further modification of the apparatus of FIGS. 14 to 16, in which the pulleys 466 and slide 469 are moved in rollers 470 by means of a reciprocally-driven wheel 492 and crank 494 is shown in FIG. 17.

The gate 465 and any of the modified versions of the gate as described herein could be used as any of the closures 8, 80, 180, and 380 in the systems shown in FIGS. 1, 4, 9, and 11, respectively.

The invention may also be adapted for use in dividing a stream 500 consisting of a stack of rod-like articles on laterally-spaced conveyor bands 502, as shown in FIG. 18. A plate 504 is guided for vertical movement between the bands 502 and carries at its upper end a first pair of laterally-spaced pulleys 506 and a second pair of laterally-spaced pulleys 508. The axes of rotation of the first and second pairs of pulleys 506, 508, respectively, are slightly offset. Bands 510 pass from a fixed position 512, around the pulleys 506, and around a fixed rotatable pulley 514 to reversible drive means 515 for the bands. Similarly, bands 516 pass from a fixed position 518, around the pulleys 508 and further fixed rotatable pulleys 520 to reversible drive means 515 for the bands. The plate 504 is biased upwards, against tension in the bands 510, 516 by means of a tension spring 522.

The plate 504 is movable from a position at which the pulleys 506, 508 are retracted below the level of the bands 502 to an upper position at which the plate is projected through the stream 500 on the bands 502. The position and movement of the plate is controlled by the reversible drive means 515 for the bands 510, 516. As the drive means 515 allows more slack in the band the spring 522 moves the plate upwards thereby maintaining tension in the band. During this movement the side parts of the bands 510, 516 in contact with the articles in the stream 500 remain stationary; this minimises disturbance and degradation of the articles in the stream. The movement of the bands around the pulleys 506, 508 is in opposite directions away from one another during projection of the plate into the stream, so that articles will tend to be moved away from the advancing plate. Conversely, when the plate 504 is withdrawn articles will tend to be moved into the void left by the retracting plate.

Instead of moving the plate by means of the tension spring 522 under controlled movement of the bands 510, 516, the plate could be directly moved with the bands being maintained taut by tensioning means.

Although a divider constituted by the present arrangement is probably wider than a conventional divider plate for a stream of rod-like articles (as disclosed, for example, in British Patent Specification No. 1,404,141), this apparent disadvantage is offset by the minimal disturbance to the stream which this arrangement can achieve due to the stationary side bands and the action of the top pulleys in moving articles out of the path of the divider. It should also be noted that this divider arrangement may be adapted for use in conjunction with the conveyor 16 in an embodiment such as described in connection with FIG. 2, for example.

The divider could be made narrower if the pulleys 506, 508 were coaxial. In this case additional pulleys or other guide means could be provided to keep the moving runs of the bands inside the stationary outer runs.

We claim:

1. A conveyor system for rod-like articles of the tobacco industry, comprising conveyor means for moving articles as a continuous, multi-layer stream and having spaced means defining a plurality of outlets through each of which a substantially-continuous flow of said articles may be selectively delivered, movable reservoir means including a plurality of adjacent substantially-vertical compartments disposed in line in the direction of movement thereof and movable into registration with said conveyor means so that at least two compartments are positioned simultaneously adjacent at least two of said outlets so that each may receive a substantially-continuous multi-layer stream of articles moving downwards from said conveyor means, means for bounding a leading end of a stack of articles in a compartment and for moving the leading end progressively so that a substantially-continuous stream of said articles extends from said conveyor means into the compartment, and means for closing said outlets so that said movable reservoir means may be separated from said conveyor means for replacement by further movable reservoir means.

2. A conveyor system as claimed in claim 1, including control means for varying the rate at which stacks of articles are conveyed in said compartments, said control means including a sensor located to respond to variations in the flow rate in said conveyor means.

3. A conveyor system as claimed in claim 1, including reversibly-driven platform means for supporting a stack of articles in each compartment.

4. A conveyor system as claimed in claim 1, 2 or 3, including means for returning articles from the reservoir means to said conveyor means.

5. A conveyor system for rod-like articles comprising first and second conveyor means for moving said articles in stack formation in a direction transverse to their lengths, first means defining a plurality of outlets for delivering articles from said first conveyor means, second means defining at least one inlet for delivering articles to said second conveyor means, said outlet and inlet being spaced apart, movable reservoir means having a plurality of compartments disposed adjacent to one another in line in the direction of movement thereof, each compartment having a separate entrance and exit for articles, means defining a path for said reservoir means whereby the reservoir means may be positioned on said path so that a plurality of compartments may be loaded simultaneously with articles passing from said outlets to the entrance of said compartments and whereby the reservoir means may be positioned on said path so that a compartment may be unloaded by articles passing from the exit of said compartment to said inlet, said outlet and inlet providing openings of substantially the same width as said compartment and said entrance and said exit being of substantially the same width so that a stack of substantially-constant width may be conveyed to, in and from each of said compartments, means for bounding a leading end of each stack advanced from each outlet through said entrance and into a compartment so that said stack is conveyed substantially continuously from said first conveyor means without substantial change of formation to said exit and third means for delivering a substantially-continuous stack received from said compartments through said inlet for conveyance by said second conveyor means without substantial change in formation.

6. A conveyor system as claimed in claim 5, further including means for bringing the entrance of each compartment into registration with an outlet to receive articles directly from said first conveyor means through said outlet.

7. A conveyor system as claimed in claim 5, wherein said compartments and said outlet and inlet are arranged so that compartments may be loaded and unloaded by articles moving under action of gravity.

8. A conveyor system as claimed in claim 7, wherein said compartments comprise substantially-vertical channels.

9. A conveyor system as claimed in claim 8, wherein said third means includes substantially-horizontal conveyor means extending below said compartments for moving articles in stack formation from the exits of a plurality of compartments to a common exit for said compartments, said common exit having a width corresponding to that of said inlet.

10. A conveyor system as claimed in claim 9, wherein said horizontal conveyor means carries removable divider plates which are spaced apart by a distance corresponding to the width of a compartment.

11. A conveyor system as claimed in claim 5, including removable closure means for said outlet.

12. A conveyor system as claimed in claim 5, wherein each compartment has releasable closure means associated with its exit.

13. A conveyor system as claimed in claim 5, wherein the reservoir means includes at least one trolley.

14. A conveyor system as claimed in claim 5, further including sensor means for initiating the loading or unloading of a compartment in response to conditions in said first conveyor means.

15. A conveyor system as claimed in claim 5, wherein said first conveyor means and said second conveyor means are arranged to convey stacks of said width adjacent said outlet and said inlet, respectively.

16. A conveyor system comprising first conveyor means for moving articles in stack formation and having spaced means defining a plurality of outlets through which stacks of articles may be delivered;

second conveyor means for conveying articles in stack formation and having spaced means defining an inlet through which a stack of articles may be received, said outlet being at a higher level than said inlet;

movable reservoir means including a plurality of adjacent substantially-vertical compartments disposed in line in the direction of movement thereof and each having a spaced upper entrance and a lower exit, said reservoir means being movable into simultaneous registration with said first and second conveyor means so that an entrance of at least two compartments is positioned simultaneously adjacent at least two of said outlets so that each may receive a substantially-continuous stack of articles moving downwards from said first conveyor means, an exit of at least one compartment being positioned adjacent said inlet to deliver a substantially-continuous stack moving downwards through said compartment to said second conveyor means; and means for closing said outlets so that said movable reservoir means may be separated from said first and second conveyor means for replacement by further movable reservoir means.

17. A conveyor system as claimed in claim 16, wherein the reservoir means further includes a movable support means for a stack in each compartment, third conveyor means arranged to receive rod-like articles from the compartments and for moving the articles to said second conveyor means, and means for selectively releasing articles from one or more compartments to said third conveyor means.

18. A conveyor system as claimed in claim 17, wherein the support means forms part of said releasing means.

19. A conveyor system as claimed in claim 17, wherein said reservoir means comprises a number of substantially-vertical compartments adapted to receive rod-like articles at their upper ends.

20. A conveyor system as claimed in claim 19, wherein said third conveyor means comprises an endless conveyor arranged below said compartments.

* * * * *